United States Patent [19]

Caspari

[11] 3,981,809

[45] Sept. 21, 1976

[54] BIS-ANILINE DISULFIDE REACTION PRODUCTS AS MULTIFUNCTIONAL LUBRICATING OIL ADDITIVES

[75] Inventor: Gunter Caspari, Wheaton, Ill.

[73] Assignee: Standard Oil Company, Chicago, Ill.

[22] Filed: Dec. 10, 1975

[21] Appl. No.: 639,330

[52] U.S. Cl. ..... 252/32.7 E; 252/32.7 HC; 252/46.7; 252/400 A

[51] Int. Cl.[2] ..... C10M 1/48; C10M 3/42; C10M 5/24; C10M 7/46

[58] Field of Search ..... 252/32.5, 32.7 E, 46.7, 252/400 A, 32.7 HC

[56] References Cited

UNITED STATES PATENTS

| | | | |
|---|---|---|---|
| 3,031,487 | 4/1962 | Chenicek | 252/32.5 |
| 3,499,838 | 3/1970 | Braid | 252/32.7 E |
| 3,846,317 | 11/1974 | Lintzenich | 252/46.7 |
| 3,914,241 | 10/1975 | Elliott et al. | 252/32.7 E |

FOREIGN PATENTS OR APPLICATIONS

| | | | |
|---|---|---|---|
| 1,165,085 | 9/1969 | United Kingdom | 252/47 |

*Primary Examiner*—Delbert E. Gantz
*Assistant Examiner*—I. Vaughn
*Attorney, Agent, or Firm*—Frank J. Sroka; Arthur G. Gilkes; William T. McClain

[57] ABSTRACT

Disclosed are lubricating oil compositions containing from about 0.01 weight percent to about 5 weight percent of an oil-soluble multifunctional additive comprising:

a. aniline disulfide dihydrocarbyl phosphoramide; or
b. aniline disulfide dihydrocarbyl dithiophosphate; or
c. aniline disulfide-phospho-sulfurized olefin;

where the hydrocarbyl groups are entirely hydrocarbon, or chloro, bromo or hydroxy substituted hydrocarbon. These additives may be the reaction product of bis-aniline disulfide with a) 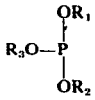 ; or b) 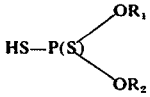 ; or c. phosphosulfurized olefin;

where $R_1$, $R_2$ and $R_3$ are hydrocarbyl or chloro, bromo or hydroxy substituted hydrocarbyl. The disclosed compositions have improved extreme pressure, anti-wear, anti-oxidant, or dispersancy properties.

20 Claims, No Drawings

BIS-ANILINE DISULFIDE REACTION PRODUCTS AS MULTIFUNCTIONAL LUBRICATING OIL ADDITIVES

SUMMARY OF THE INVENTION

It is well known that various additives can be added to lubricating oils in order to improve various oil properties and to make a more satisfactory lubricant. This invention relates to lubricating oil compositions and multifunctional additives. More specifically, it relates to oil compositions having improved extreme pressure, anti-wear, anti-oxidant, or dispersancy properties.

The improved lubricants of this invenion are lubricating oil compositions containing from about 0.01 weight percent to about 5 weight percent of an oil-soluble multifunctional additive comprising:

a. aniline disulfide dihydrocarbyl phosphoramide; or b. aniline disulfide dehydrocarbyl dithiophosphate; or c. aniline disulfide-phospho-sulfurized olefin;

where the hydrocarbyl groups are entirely hydrocarbon, or chloro, bromo or hydroxy substituted hydrocarbon. These additives may be the reaction product of bis-aniline disulfide with

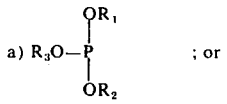

a) $R_3O-P(OR_1)(OR_2)$ ; or

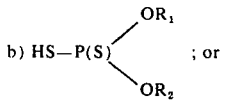

b) $HS-P(S)(OR_1)(OR_2)$ ; or c. phosphosulfurized olefin;

where $R_1$, $R_2$ and $R_3$ are hydrocarbyl or chloro, bromo, or hydroxy substituted hydrocarbyl. Preferably about 0.05 weight percent to about 2 weight percent of the oil-soluble multifunctional additive is used. The oil composition has improved extreme pressure, anti-wear, anti-oxidant, or dispersancy properties.

$R_1$, $R_2$ and $R_3$ can be any hydrocarbyl or chloro, bromo or hydroxy substituted hydrocarbyl. $R_1$, $R_2$ and $R_3$ can be alkyl, aryl or alkyl substituted aryl groups. $R_1$, $R_2$ and $R_3$ can be a straight chain or branched low molecular weight alkyl such as isobutyl, nonyl, and the like; an intermediate molecular weight polypropylene or butylene polymer having a number average molecular weight from about 80 to about 5,000; high molecular weight polyolefins having a number average molecular weight up to about 100,000 or even higher; and others. $R_1$, $R_2$ and $R_3$ can be aryl such as benzene ring or alkyl substituted aryl such as a mono or poly alkyl substituted benzene. These R groups may be entirely hydrocarbon or substituted with chlorine, bromine or hydroxy groups but the final substituted aniline disulfide must still be oil-soluble. These R groups often contain about 1 to about 50, preferably about 1 to about 20, and still more preferably about 1 to about 10 carbon atoms.

Bis-aniline disulfides, such as ortho and para bis-aniline disulfide, can be reacted with dihydrocarbyl dithiophosphoric acid, phosphosulfurized hydrocarbons, or trialkylphosphites by simply mixing the two components alone or in presence of inert organic solvents, such as benzene, toluene, hexane or trichloroethylene.

The reaction mixture is usually maintained at a moderate temperature, preferably in the range of from about 70° to 150°C.

The molar ratio of reactants may range from about 0.5 to about 3:1 of bis-aniline disulfide to dihydrocarbyl dithiophosphoric acid, phosphosulfurized hydrocarbons, or trialkylphosphite, preferably 1:2 for the reaction of bis-aniline disulfide with dithiophosphoric acid or trialkylphosphite, preferably 1:1 for the reaction with phosphosulfurized hydrocarbon.

The principle of the reaction of amines with dihydrocarbyl dithiophosphoric acid is outlined by R. F. Neblett and N. Tunkel in U.S. Pat. No. 3,511,780. The reaction of aromatic amines with trialkylphosphites is described by D. Amos and R. G. Gillis in Aust. J. Chem. 22, 1555 (1969) and by U. Pilgrim and F. Worte in Tetrahedron 19, 137 (1963).

The preparation of phosphosulfurized hydrocarbons is well known in the art and involves reacting a sulfide of phosphorus such as $P_2S_3$, $P_2S_5$, $P_4S_7$, and the like, preferably $P_2S_5$, with a hydrocarbon material such as a terpene, heavy petroleum fraction or olefin. A terpene is an unsaturated hydrocarbon having an empirical formula $C_{10}H_{16}$ which is usually isolated from plant sources. The preparation of phosphosulfurized hydrocarbons is more fully described in U.S. Pat. Nos. 2,875,188 and 2,316,078.

The term "olefin" as used herein and in the appended claims, also refers to amorphous copolymers derived from olefinically unsaturated monomers. Such olefin monomers include olefins of the general formula $RCH{=}CH_2$, in which R is an aliphatic or cycloaliphatic radical of from 1 to about 20 carbon atoms, for example, propene, isobutylene, butene-1, hexene-1, 4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These olefins often have number average molecular weights from about 100 to about 100,000, preferably from about 100 to about 1,000.

Phosphosulfurized hydrocarbons can be prepared by reacting a hydrocarbon base stock with from about 5 to 40 wt. percent of a sulfide of phosphorus, preferably from about 10 to 20 wt. percent of phosphorus pentasulfide. The reaction is conducted under anhydrous conditions at temperatures from about 150° to about 600°F. for from about ½ to about 15 hours. Similarly, low molecular weight olefins can be reacted with the above-described phosphorus sulfides. Such olefins include isobutylene, decene, dodecene, cetene, octadecene, cerotene and terpenes such as dipentene, terpolene and pinenes such as alpha pinenes.

The lubricating oils in which the compositions of this invention are useful as additives may be of synthetic, animal, vegetable, or mineral origin. Ordinarily mineral lubricating oils are preferred by reason of their availability, general excellence, and low cost. For certain applications, oils belonging to one of the other three groups may be preferred. For instance, synthetic polyester oils such as didodecyl adipate and di-2-ethylhexyl sebacate are often preferred as jet engine lubricants. Normally the lubricating oils preferred will be fluid oils, ranging in viscosity from about 40 Saybolt Universal seconds at 100°F. to about 200 Saybolt Universal seconds at 210°F.

This invention contemplates also the presence of other additives in lubricating compositions. Such additives include, for example, viscosity index improving agents, pour point depressing agents, anti-foam agents, extreme pressure agents, rust-inhibiting agents, and oxidation and corrosion inhibiting agents.

The following compounds were made for testing.

EXAMPLE 1

Bis(o-aniline)disulfide 500 g (4 mol) o-aminobenzenethiol were dissolved in 1680 ml dimethylsulfoxide. The mixture was stirred for 8 hours at 80°–90°C. The solution was poured into 10x amount of ice-water. After 3 hours, the crystalline product was filtered and dried at 50°C. in a vacuum oven. Yield — 470 g.

EXAMPLE 2

Bis(p-aniline)disulfide

The disulfide prepared as described in "Organic Synthesis", Collective Vol. 3, p. 86, published by John Wiley and Sons, Inc. 1968.

EXAMPLE 3

2,2'-Aniline disulfide-N,N'-diethyl phosphoramide

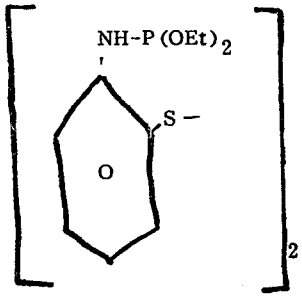

50 g (0.2 mol) bis(2-aniline) disulfide and 82 g (0.05 mol) triethylphosphite were dissolved in 150 ml toluene. The mixture was heated to 85°C for 3 hours under nitrogen and with stirring. The solvent and excess phosphite were removed by distillation at 60°C/2 Torr. Yield — 80 g.

Elemental Analysis:

| | C | H | N | P | S |
|---|---|---|---|---|---|
| % found | 51.9 | 6.41 | 5.6 | 12.9 | 14.9 |
| % calc. | 52.6 | 6.58 | 6.15 | 13.6 | 14.0 |

EXAMPLE 4

2,2'-Anilinium disulfide-bis-diamyl-dithiophosphate

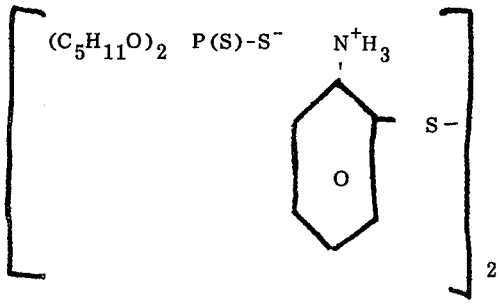

25 g (0.1 mol) bis(2-aniline) disulfide and 54 g (0.2 mol) diamyl-dithiophosphoric acid were dissolved in 100 ml toluene. The mixture was heated to 80°C. for 2 hours under nitrogen with stirring. Removal of toluene in vacuum yielded the reaction product.

Elemental Analysis:

| | C | H | N | P | S |
|---|---|---|---|---|---|
| % found | 49.8 | 7.34 | 3.25 | 7.3 | 24.4 |
| % calc. | 48.7 | 7.36 | 3.55 | 7.8 | 24.4 |

EXAMPLE 5

$\alpha$-olefin($C_{15-20}$)-$P_2S_5$-bis(o-aniline) disulfide 50 g $\alpha$-olefin ($C_{15-20}$)-$P_2S_5$(P-6.9%; S-16.7%) were dissolved in 100 ml toluene; 25 g bis(o-aniline) disulfide in 100 ml hot toluene were added portion-wise to the $\alpha$-olefin $P_2S_5$ solution at 80°C. within 1 hour. The mixture was stirred for 2 hours under nitrogen. The solvent was recovered by forcing $N_2$ through the liquid phase. %N-3.5; %P-12.7; %S-18.8.

EXAMPLE 6

4,4'-Aniline disulfide-N,N'-diethylphosphoramide, prepared according to Example 3.

| | C | H | N | P | S |
|---|---|---|---|---|---|
| % found | 52.2 | 6.31 | 6.3 | 12.8 | 14.5 |
| % calc. | 52.6 | 6.58 | 6.15 | 13.6 | 14.0 |

EXAMPLE 7

4,4'Anilinium disulfide-bis-diamyl-dithiophosphate prepared according to Example 4.

| | C | H | N | P | S |
|---|---|---|---|---|---|
| % found | 49.1 | 7.50 | 3.49 | 7.2 | 23.9 |
| % calc. | 48.7 | 7.36 | 3.55 | 7.8 | 24.4 |

EXAMPLE 8

2,2'-Anilinium disulfide-bis-didecyl-dithiophosphate prepared according to Example 4. %N-2.7; %P-5.45; %S-16.9.

EXAMPLE 9

2,2'-Aniline disulfide-N,N'-dimethyl phosphoramide prepared according to Example 3. %N-6.2; %P-7.9; %S-14.5.

EXAMPLE 10

$\alpha$-olefin ($C_{15-20}$) $P_2S_5$-4-aniline disulfide prepared according to Example 5. %N-3.5; %P-13.45; %S-19.2. The anti-wear properties of the oil formulation were assessed by means of the Four-Ball test. The Four-Ball test is usually referred to as the "Shell Four-Ball Test", introduced by Boerlage, G. D., Engineering 136, 46–47 (1933). This method consists of an apparatus where a single ball rotates under variable load on a support formed by three similar balls locked together in an oil cup. The Four-Ball machine was run at 130°F. at a load of 15, 30, and 50 kg at a speed of 1800 rpm. The wear scar diameter on the balls was measured after 30 min.

| Oil Formulation: | 5w oil |
|---|---|
| Test Conditions: | 1800 rpm; 130°F; 0.5 hr.; additive concentration = 0.5 wt. % |

| Additive | Wear Scar Diameter (mm) 15 kg | 30 kg | 50 kg |
|---|---|---|---|
| Example 1 | 0.45 | 0.65 | 0.85 |
| Example 2 | 0.43 | 0.60 | 0.78 |
| Example 3 | 0.45 | 0.50 | 0.70 |
| Example 4 | 0.30 | 0.45 | 0.65 |
| Example 5 | 0.35 | 0.40 | 0.65 |
| Example 6 | 0.41 | 0.55 | 0.70 |
| Example 7 | 0.30 | 0.45 | 0.60 |
| Example 8 | 0.35 | 0.48 | 0.65 |
| Example 10 | 0.30 | 0.40 | 0.62 |

The extreme pressure properties were assessed by the Falex Lubricant Tester (ASTM D3233). The test consists of pressing a rotating steel journal at 290 rpm against two stationary steel V-blocks immersed in the lubricant sample. Load is applied by an automatic loading ratchet and is increased to 500 lbs. The machine is allowed to run at this pressure for three minutes (break-in period). The load is then increased at a rate governed by the automatic ratchet until failure occurs.

| Oil Formulation: | 7% Dispersant<br>5% Viscosity Index Improver<br>1.9% Methylene bis-dodecyl phenol<br>40% 5w oil<br>Balance: 10 w oil |
|---|---|

| Additive | Conc. (wt %) | Jaw Load at failure (lbs) |
|---|---|---|
| No additive | 1 | 500 |
| Example 1 | 1 | 1,250 |
| Example 2 | 1 | 1,300 |
| Example 3 | 1 | 1,500 |
| Example 4 | 1 | 1,650 |
| Example 5 | 1 | 1,650 |
| Example 6 | 1 | 1,600 |
| Example 7 | 1 | 1,750 |
| Example 10 | 1 | 1,700 |

Anti-oxidative properties of oil composition were measured by an oil thickening test. In this test 100 grams of test oil are oxidized at 350°F. in an open oxidation tube, while being blown with 600 cc air/minute. Oxidation is catalyzed by the addition of 5% of a Ford VC drain oil. Samples are taken periodically and their viscosity determined to give a viscosity-time curve. The time in hours for a four-fold increase in viscosity over the initial viscosity (4 VO) is noted; a long 4 VO indicates resistance to oil thickening by oxidation. Also, a sample of this oil after 48 hours of oxidation is run in the Spot Dispersancy Test which gives a measure of the oil's ability to disperse sludge and varnish. In the Spot Dispersancy Test, 3–10 drops of oil are dropped onto a standard white blotter paper. After 24 hours, the diameter of the sludge spot and the oil spot are measured. Dispersancy is reflected by the ability of an oil to keep sludge in suspension. Thus, dispersancy will be reflected by the difference in diameters of the sludge and oil spots. A rating (SDT Rating) is given by the diameter of the sludge spot divided by the diameter of the oil spot, and multiplied by 100. A high numerical rating indicates good dispersancy.

OIL OXIDATION AND DISPERANCY TEST

| Oil Formulation: | 7% Dispersant<br>5% Viscosity Index Improver<br>1.9% Methylene bis-dodecyl phenol<br>40% 5w oil<br>Bal. 10w oil |
|---|---|

| Additive | Conc. (wt %) | 4Vo (hrs) | % Dispersancy After 48 hrs. |
|---|---|---|---|
| No additive | — | 29 | No dispersancy |
| Bis(2-aniline)disulfide | 0.5 | 42 | No dispersancy |
| Bis(4-aniline)disulfide | 0.5 | 40 | No dispersancy |
| 2,2'-Aniline disulfide-N,N'-diethyl phosphoramide | 0.5 | 60 | 71 |
| 4,4'-Aniline disulfide-N,N'-diethyl phosphoramide | 0.5 | 60 | 80 |
| 2,2'-Anilinium disulfide-bis-diamyl dithiophosphate | 0.5 | 53 | 71 |
| 4,4'-Anilinium disulfide-bis-diamyl dithiophosphate | 0.5 | 51 | 65 |
| α-olefin($C_{15-20}$)-bis(2-aniline)disulfide | 0.5 | 50 | 65 |
| α-olefin($C_{15-20}$)-bis(4-aniline)disulfide | 0.5 | 50 | 63 |
| 2,2'-Aniline disulfide-N,N'-dimethyl phosphoramide | 0.5 | 53 | 47 |
| 2,2'-Anilinium disulfide-N,N'-didecyl dithiophosphate | 0.5 | 51 | 69 |

As can be seen, the various substituted aniline disulfides provide lubricating oils with improved extreme-pressure, anti-wear, anti-oxidant or dispersancy properties.

I claim:

1. A lubricating oil composition containing from about 0.01 weight percent to about 5 weight percent of an oil-soluble multifunctional additive comprising the reaction product of bis-aniline disulfide with a) 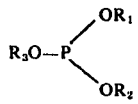 ; or b) 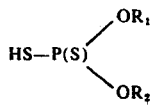 ; or c. phosphosulfurized olefin;

where $R_1$, $R_2$ and $R_3$ are hydrocarbyl or chloro, bromo or hydroxy substituted hydrocarbyl.

2. The composition of claim 1 containing from about 0.05 weight percent to about 2 weight percent of an oil-soluble multifunctional additive.

3. The composition of claim 1 wherein $R_1$, $R_2$ and $R_3$ are alkyl, aryl or alkyl substituted aryl.

4. The composition of claim 1 wherein $R_1$, $R_2$ and $R_3$ contain from about 1 to about 50 carbon atoms.

5. The composition of claim 4 wherein $R_1$, $R_2$ and $R_3$ contain from about 1 to about 20 carbon atoms.

6. The composition of claim 5 wherein $R_1$, $R_2$ and $R_3$ contain from about 1 to about 10 carbon atoms.

7. The composition of claim 3 wherein $R_1$, $R_2$ and $R_3$ are alkyl.

8. The composition of claim 7 wherein $R_1$, $R_2$ and $R_3$ are ethyl.

9. The composition of claim 7 wherein $R_1$, $R_2$ and $R_3$ are amyl.

10. The composition of claim 1 wherein the multifunctional additive comprises the reaction product of bis-aniline disulfide with a phosphosulfurized olefin.

11. The composition of claim 10 wherein the phosphosulfurized olefin is made from polyolefin having number average molecular weights from about 100 to about 100,000.

12. The composition of claim 11 wherein the phosphosulfurized olefin is made from olefins having number average molecular weights from about 100 to about 1,000.

13. The composition of claim 10 wherein the olefin is polybutene.

14. The composition of claim 13 wherein the olefin has a number average molecular weight of about 600.

15. The composition of claim 1 wherein the bis-aniline disulfide is bis(o-aniline) disulfide or bis(p-aniline) disulfide.

16. A lubricating oil composition containing from about 0.01 weight percent to about 5 weight percent of an oil-soluble multifunctional additive comprising a. aniline disulfide dihydrocarbyl phosphoramide; or b. aniline disulfide dihydrocarbyl dithiophosphate; or c. aniline disulfide-phospho-sulfurized olefin;

where the hydrocarbyl groups are entirely hydrocarbon, or chloro, bromo or hydroxy substituted hydrocarbon.

17. The composition of claim 16 wherein the hydrocarbyl groups contain from about 1 to about 50 carbon atoms.

18. The composition of claim 17 wherein the hydrocarbyl groups contain from about 1 to about 20 carbon atoms.

19. The composition of claim 18 wherein the hydrocarbyl groups contain from about 1 to about 10 carbon atoms.

20. The composition of claim 16 wherein the hydrocarbyl groups are alkyl, aryl or alkyl-substituted aryl.

* * * * *

UNITED STATES PATENT OFFICE

CERTIFICATE OF CORRECTION

Patent No. 3,981,809 Dated September 21, 1976

Inventor(s) Gunter Caspari

It is certified that error appears in the above-identified patent and that said Letters Patent are hereby corrected as shown below:

Abstract b) $OR_1$ and $OR_2$ should be bound to P and not (S)

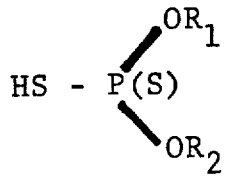

Col. 1, line 32 $OR_1$ and $OR_2$ should be bound to P and not (S)

" 6 " 60 $OR_1$ and $OR_2$ should be bound to P and not (S)

" 7 " 10 "alkvl" should be -- alkyl

Signed and Sealed this

Eighteenth Day of January 1977

[SEAL]

*Attest:*

RUTH C. MASON
*Attesting Officer*

C. MARSHALL DANN
*Commissioner of Patents and Trademarks*